United States Patent [19]

Perlman

[11] Patent Number: 4,754,674

[45] Date of Patent: Jul. 5, 1988

[54] SHEET CUTTING AND DISPENSING DEVICE

[75] Inventor: Daniel Perlman, Arlington, Mass.

[73] Assignee: Brandeis University, Waltham, Mass.

[21] Appl. No.: 40,265

[22] Filed: Apr. 17, 1987

[51] Int. Cl.[4] ..... B65H 75/32

[52] U.S. Cl. ..... 83/422; 83/436; 83/455; 83/588; 83/614; 83/649

[58] Field of Search ..... 83/422, 436, 455, 456, 83/588, 614, 649

[56] References Cited

U.S. PATENT DOCUMENTS

| | | | |
|---|---|---|---|
| 992,755 | 5/1911 | Crocker | 83/455 |
| 2,450,496 | 10/1948 | Whiteley | 242/55.4 |
| 2,645,543 | 7/1953 | Mancini | 312/39 |
| 3,137,192 | 6/1964 | McNeill | 83/455 |
| 3,142,217 | 7/1964 | Busse | 83/375 |
| 3,277,760 | 10/1966 | Keene et al. | 83/455 |
| 3,561,312 | 2/1971 | Jones | 83/485 |
| 4,158,977 | 6/1979 | Logan | 83/614 X |
| 4,245,536 | 1/1981 | Urion | 83/821 |
| 4,383,458 | 5/1983 | Kitai et al. | 83/455 X |
| 4,535,664 | 8/1985 | Raymond | 83/614 X |

*Primary Examiner*—Frank T. Yost

*Attorney, Agent, or Firm*—Hamilton, Brook, Smith & Reynolds

[57] ABSTRACT

A cutting and dispensing device (10) having a cutting blade (60) movable along a straight path, a feed means (20) at the entry side of the path of movement and an anvil surface (74) engageable with a pressure wheel (80) at the exit side of the path which, together with the feed means, grip the sheet material during cutting.

18 Claims, 4 Drawing Sheets

Fig. 4
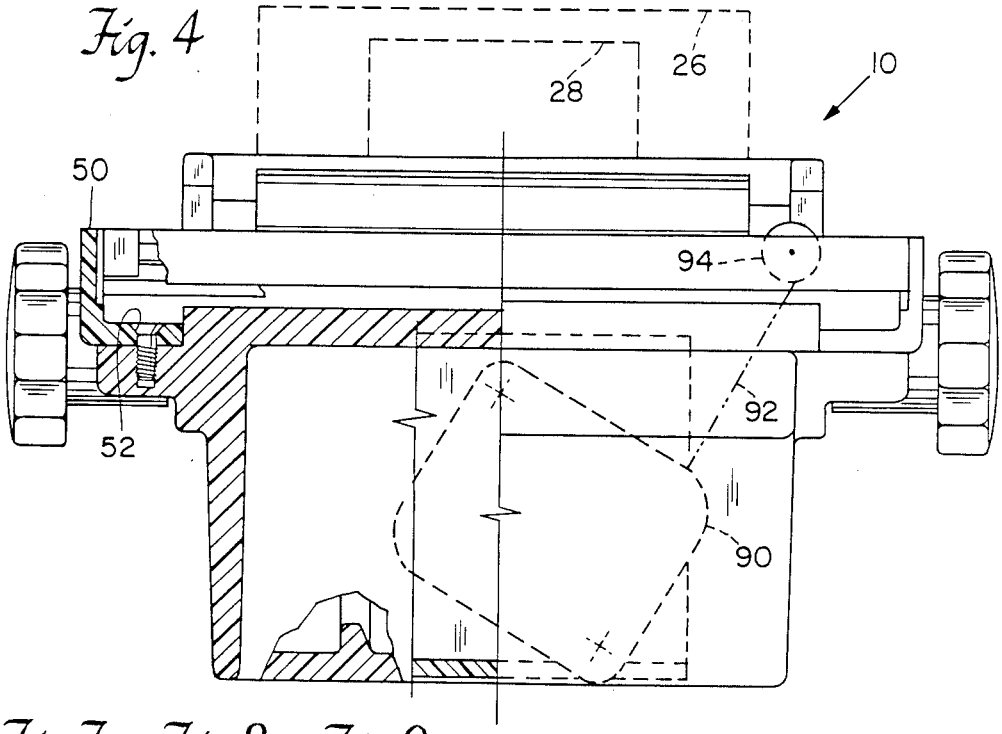
Fig. 7 Fig. 8 Fig. 9
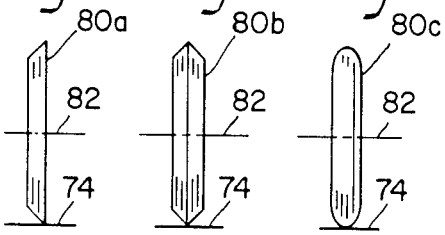
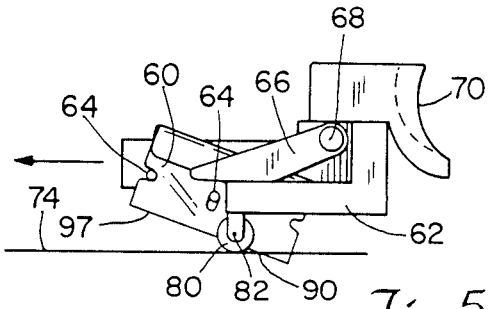
Fig. 5
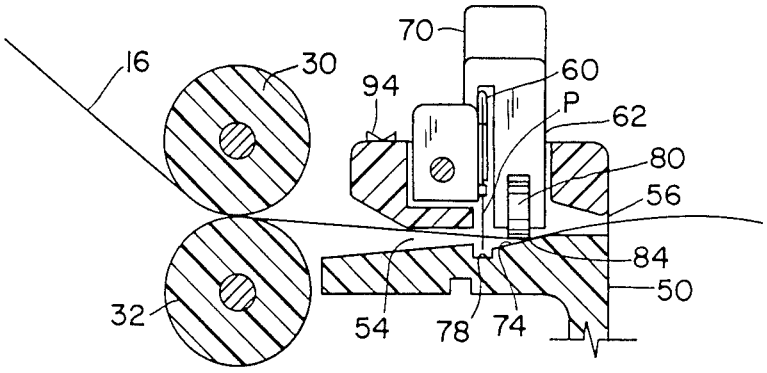
Fig. 6

SHEET CUTTING AND DISPENSING DEVICE

FIELD OF THE INVENTION

This invention relates to sheet feeding and cutting devices, generally, and more particularly, to mechanisms particularly adapted for cutting laboratory film of the type which is adherent to smooth surfaces, is supplied in rolls and which includes a thin, strong, backing layer.

BACKGROUND OF THE INVENTION

Laboratory film is typically a waterproof plastic or parafilm-type sheet material, which stretches and adheres to smooth surfaces when it is wrapped under tension over and around openings, joints and the like. It is used universally in laboratories in great quantities. Being adherent and being supplied from a roll, it is backed by a loosely adherent, thin, strong release paper. One such laboratory film is known as Parafilm "M" supplied by the American Can Company of Greenwich, Conn.

Being supplied in rolls, requires that the film be cut off, a piece at a time, including the backing paper. The two layers, often called a bi-layer, are, as a single sheet normally pulled from the roll which is supplied in cardboard dispenser boxes. It is cut to the desired length, often by scissors.

There are also commercial dispensers for films of this type. One type incorporates a lever operated, razor cutter. The film is pulled out to the desired length, and while pulling on the film to cause tension, the operator moves a lever on the box. This causes the razor blade to traverse and cut the film, including the backing. However, the device requires a two-handed operation, and is generally cumbersome since its use requires the operator to lay down the object to which he desires to apply the film, such as a test tube or other vial.

One problem in cutting paper-backed laboratory film with a scissors is that the film is caused to adhere to the backing along the line of cut, since the scissors cut involves two metal blades engaging each other and squeezing the film and paper together.

One of the objects of this invention is to provide a cutting mechanism, wherein the cutting blade engages only the film and its backing, not another metal object.

The film is generally provided on a cardboard roll, which is mounted for rotation in a commercial cardboard box. The film is pulled from the box while the roll rotates. Given this geometry, another object of this invention is to provide a sheet cutting and dispensing device which does not require the roll of film to be removed from its supply box, and where the box, including the film, can be placed in the dispenser.

The supply box need never be opened, which assures that the film will be clean and fresh each time a piece is cut from the roll.

Another object of this invention is to provide a cutting and dispensing device, which can be operated solely with one hand.

SUMMARY OF THE INVENTION

The invention resides in a sheet cutting and dispensing device comprising a cutting blade which is supported in a vertical plane by means movable along a straight path. The blade has a cutting edge which is inclined upwardly at an acute angle when measured in the direction of movement. There are feed means located on one side of the path of movement of the blade for feeding and positioning sheet material such as bi-layer, laboratory film in the path of movement of the blade.

An anvil is located on the opposite side of the path of movement of the blade and is engageable with the undersurface of the sheet material. A pressure wheel is mounted for movement with the blade and is rotatable about an axis which is normal to the direction of movement of the blade. The pressure wheel engages the upper surface of the sheet material, which is supported by the anvil and traverses said sheet material along a line which is parallel to the direction of movement of the blade.

The sheet is thus supported by the feed means on one side of the path of movement of the blade and by the pressure wheel and anvil on the opposite side of the path of movement. It is unsupported along the path of movement of the blade, so that, when the blade severs the sheet material, it is a free or single blade shear cut as distinguished from a scissors or multiblade guillotine cut.

A wide and sufficiently deep clearance space is located below the path of movement of the blade, so that the blade engages only the sheet material during the cutting operation.

The axis of rotation of the pressure wheel is located in advance of the point where the edge of the blade intersects the plane of the sheet material. In this way, the sheet material is held firmly against the anvil at all times in advance of the point of cut.

Means are provided for returning the cutting blade to the start position to make it ready for another cut when the sheet material is advanced to a cutting position. The return means comprises a constant force spring which is connected to the blade support means to return the blade automatically after each cut.

The blade supporting means is releasable to permit the blade to be replaced when dulled from repeated uses.

The feed means, comprise a pair of resiliently mounted rubber coated rollers which between them apply pressure to the sheet material at all times.

The above and other features of the invention, including various novel details of construction in combinations of parts, will now be more particularly described with reference to the accompanying drawings and pointed out in the claims. It will be understood that the particular sheet cutting and dispensing device embodying the invention is shown by way of illustration only and not as a limitation of the invention. The principles and features of this invention may be employed in varied and numerous embodiments without departing from the scope of the invention.

BRIEF DESCRIPTION OF THE DRAWINGS

FIG. 4 is a front view, partially in section along the line IV—IV on FIG. 3.

FIG. 5 is a detail view of the cutting blade and its movable support means, and, FIG. 6 is a detail view of the cutting blade and its movable support means viewed from the direction of the cut.

FIGS. 7, 8 and 9 are alternative forms of the pressure wheel.

DETAILED DESCRIPTION OF THE INVENTION

Figure 1:
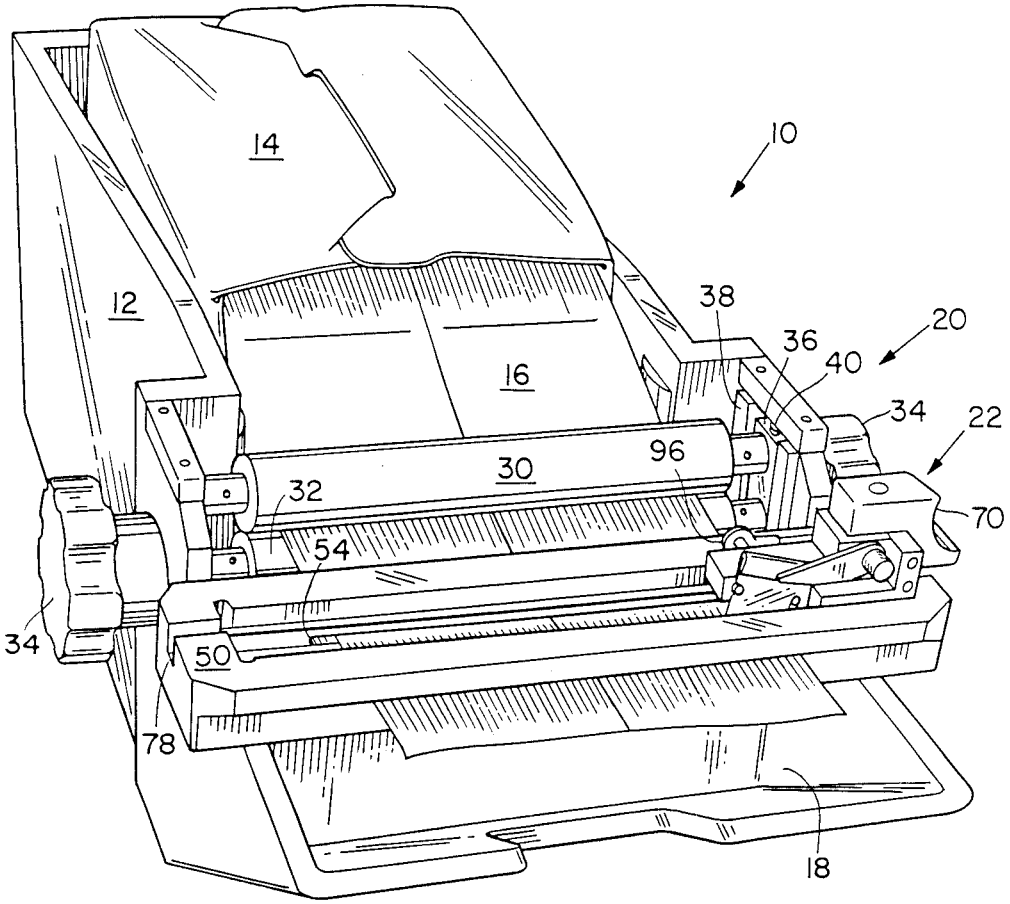
FIG. 1 is a perspective view of a sheet cutting and dispensing device embodying the invention.
Figure 2:
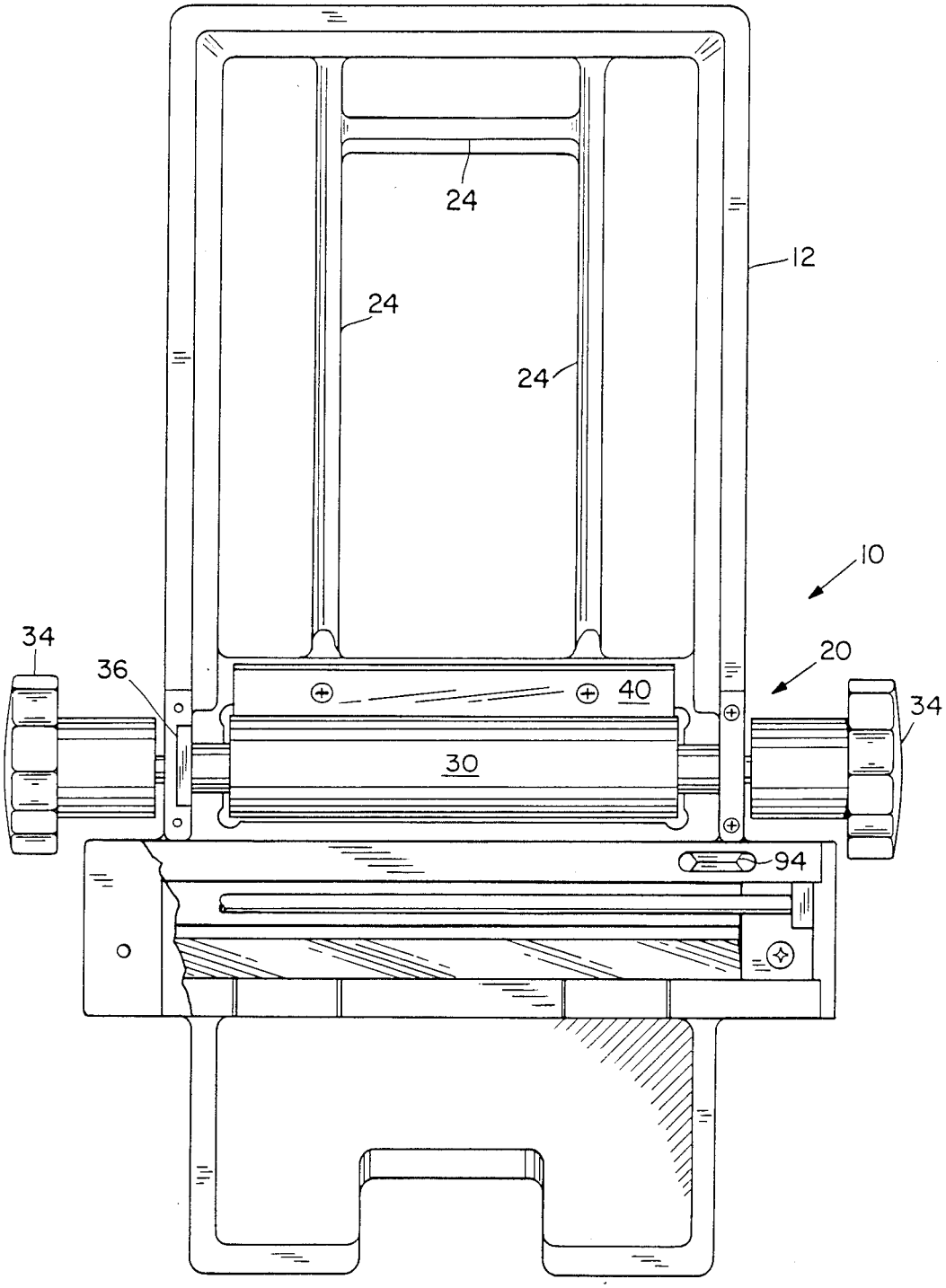
FIG. 2 is a plan view thereof.

A sheet cutting and dispensing device generally indicated 10, is seen in perspective in FIG. 1 and includes a supply portion 12 for receiving and positioning a cardboard box 14 containing a sheet of laboratory film 16 rolled on a tube. At the opposite end of the cutting device, that is, the end nearest the viewer in FIG. 1, is a dispensing area 18 into which cut pieces of laboratory film may drop and be collected for application to articles such as test tubes and the like. Intermediate the portions 12 and 18 are feed means generally designated 20 and cutter means generally designated 22.

The supply area 12 includes ribs 24, which not only provide strength, but help to hold different size packages or containers of laboratory film.

Figure 3:
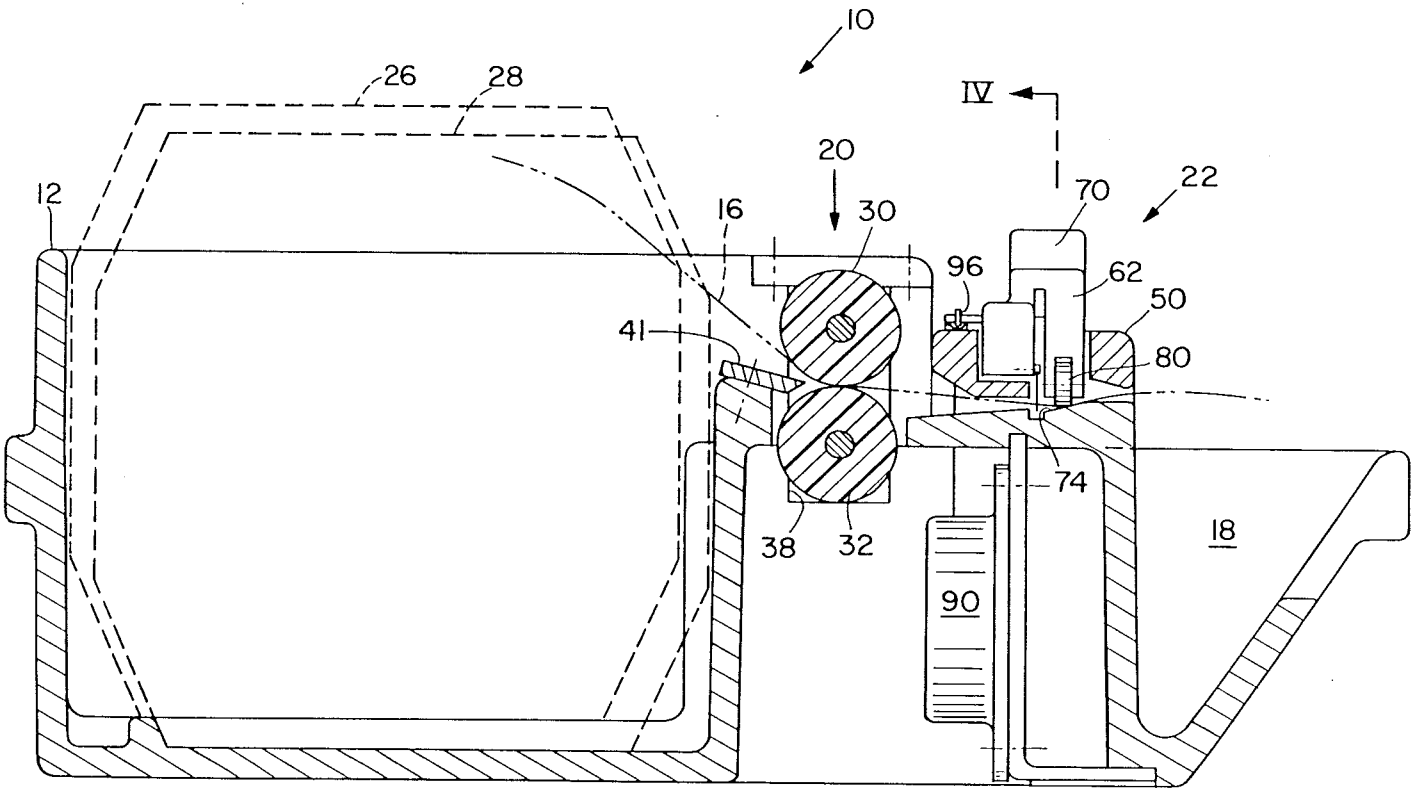
FIG. 3 is a left side view, partially in section.

As will be seen in FIGS. 3 and 4, two different size film containers are shown: a larger container 26 containing film of approximately four inches in width and a smaller container 28 which contains film of approximately two inches in width. The larger container would occupy virtually all of the volume of the supply portion 12 while resting on the ribs 24. A smaller container would occupy approximately half the box, being seated between the ribs 24.

Regardless of the width of the film, the construction of the cutter-dispenser 10 is the same, as is its operation.

The sheet 16 passes through the feed means 20, there being an upper roll 30 and a lower roll 32. The lower roll 32 is mounted for rotation in the cutter-dispenser 10 and is provided with a pair of knobs 34 so that it may be rotated with either hand. The roll 32, as is the roll 30, is covered with a flexible elastomeric material such as rubber. The upper roll 30 is mounted for vertical movement on blocks 36 which are slidable vertically in guideways 38 on opposite sides of the dispenser, only one being seen in FIG. 1. The roll 30 is biased downwardly by a spring 40 toward the lower roll 32. The sheet 16 passes between the rolls 30 and 32 and is firmly gripped as a result of the downward pressure of the spring 40.

Prior to reaching the feed means 20 the film passes over a plate 41 which serves to support and/or direct the sheet as it enters the rolls. Thereafter the sheet follows the path shown in FIG. 6. In other words, as it comes from the roll, it is inclined downwardly, first engaging the underside of the roll 30.

Extending transversely of the cutter-dispenser device, and generally parallel with the feed rolls 30 and 32, is a supporting frame 50. It is secured above the dispensing portion 18 and is held to the device by a plurality of screws 52, one of which is seen in FIG. 4. The frame 50 includes an entry slot 54 and an exit slot 56 through which the sheet 16 passes.

A cutting blade 60, which is illustrated as a single edge, backed razor blade, is supported in a vertical plane P on a carriage 62 for movement laterally of the frame 50. The blade is supported on a number of pins 64 in the carriage and is held in position by a lever 66 pivoted on the carriage 60 on a pin 68. A finger engaging member 70 is mounted on the carriage whereby the carriage including the blade may be moved in a direction from right to left as viewed in FIG. 1 to sever a piece from the sheet 16.

As seen in FIG. 6, an anvil 74 formed as a part of the frame 50, is located on the exit side of the plane of movement P of the blade, i.e., opposite to the entry side that the feed means are located on. The anvil surface 74 is engageable with the undersurface of the sheet material 16 and is inclined upwardly at an acute angle with the direction of feed which is from left to right as viewed in FIG. 6. Located beneath the blade 60 and extending lengthwise of the frame 50 is a wide and sufficiently deep clearance space 28 into which the blade 60 projects but does not touch either the bottom or sides of the space 28.

A pressure wheel 80, FIGS. 5 and 6, is mounted for movement on the carriage 62 with the blade. The wheel is rotatable about an axis 82 which is horizontal and normal to the blade 60. As seen in FIGS. 3 and 6, one circular edge 84 of the wheel 80, which is cylindrical in the embodiment shown in FIGS. 3 and 6, is engageable with the upper surface of the sheet material 16 supported on the anvil 74. It engages the sheet material along a line which is parallel to the direction of movement of the blade. Thus, there is line contact between the wheel and the sheet material. The result is that the sheet material 16 is supported by the feed means 20, specifically the rollers 30 and 32, on the entry side of the path of movement of the blade, and by the cylindrical pressure wheel 80 and anvil 74 on the exit side of the path of movement. It is unsupported along the path of movement or plane P of the blade as clearly seen in FIGS. 3 and 6.

As seen in FIGS. 7, 8 and 9, the feed wheel, illustrated respectively as **80*a*, 80*b* and 80*c*, may be frustoconical, double frustoconical or even slightly rounded at its periphery or any other equivalent configuration to produce a live contact with the sheet on the anvil 74**. In such instances the anvil may be flat or inclined.

It will be seen in FIG. 5 that the axis of rotation 82 of the pressure wheel 80 is located in advance of the point 90 (FIG. 5) where the edge 97 of the blade intersects the plane of the sheet material 16 (FIG. 6). In this manner the sheet material is held firmly against the anvil at all times in advance of being cut. Thus, the sheet material is held by the feed wheels 30 and 32 at one side of the plane of the cut, and by the pressure wheel 80 and anvil 74 on the opposite side of the cut, the material is unsupported along the line where the blade slices through it. This produces a free sheer cut, not a scissors or guillotine cut, which means that the trailing edge of each piece of film which is cut is not pressed together by the pressure wheel, and hence, the leading edge of the next piece is not pressed together. This makes it convenient to separate the film from its protective paper. The fact that the pressure wheel engages the sheet material in advance of the point of cut as distinguished from the reverse, which is true in some of the prior art devices produces a cleaner, smoother cut even when the blade has become dull and up to the point where it needs replacement.

Means are provided for moving the cutting blade opposite to the direction of the cutting movement to reposition the blade at the right hand side of the device for making another cut in the sheet material. Referring to FIGS. 3 and 4, this includes a constant tension spring located within a housing 90 connected to a thin wire 92, which passes around a pulley 94, and is attached to the carriage 62 by a pin and eye connector 96.

The device is operated in the following manner. As seen in FIG. 1, a box 14 containing a spooled roll of sheet film, is positioned within the carton portion 12. The film 16 is pulled slightly from the box, fed through the feed rolls 30 and 32 from left to right as viewed in FIGS. 3 and 6, passing into the entry slot 54, and out the exit slot 56. The carriage 62 (FIG. 1), is initially at the righthand side of the device under the tension of the constant pressure spring. The operator places one finger on the engaging member 70, moving the carriage from right to left. Upon completion of the cutting stroke, the cut piece of film drops into the dispenser 18 or can be removed by hand without clipping. The finger is removed and the spring automatically returns the carriage to the righthand side ready to make the next cut. The operator need then turn only one of the wheels 34 to advance a desired length of film to the cutting path and can operate the cutter with the same hand, the other hand being free to grasp the test tube or other article to be covered by the film.

I claim:

1. A sheet cutting and dispensing device comprising:

a cutting blade supported in a plane by means movable along a straight path, the blade having a cutting edge inclined upwardly at an acute angle in the direction of movement, feed means located on one side of the path of movement of the blade for positioning sheet material in the path of movement of the blade, an anvil on the opposite side of the path of movement of the blade engageable with one surface of the sheet material, a pressure wheel mounted for movement with the blade, the wheel being rotatable about an axis normal to the blade, the pressure wheel being engageable with the opposite surface of sheet material supported on the anvil along a line which is parallel to the direction of movement of the blade, whereby the sheet material is supported by the feed means on one side of the path of movement of the blade and by the pressure wheel and anvil on the opposite side of the path of movement, and is substantially unsupported along the path of movement of the blade.

2. A cutting and dispensing device according to claim 1 wherein, the blade is a single edge, backed razor blade.

3. A cutting and dispensing device according to claim 1 wherein, the blade is replaceable.

4. A cutting and dispensing device according to claim 1 wherein, the feed means are a pair of spring biased rolls.

5. A cutting and dispensing device according to claim 1 wherein, the axis of rotation of the pressure wheel is located in advance of the point where the edge of the blade intersects the plane of the sheet material.

6. A cutting and dispensing device according to claim 1 wherein, there are means for moving the cutting blade opposite to the direction of the cutting movement to reposition the blade for making another cut.

7. A sheet cutting and dispensing device according to claim 1 wherein, there is a clearance space through which the blade passes during the cutting operation.

8. A sheet cutting and dispensing device comprising:

a cutting blade supported in a plane by means movable along a straight path, the blade having a cutting edge inclined upwardly at an acute angle in the direction of movement, feed means located on one side of the path of movement of the blade for positioning sheet material in the path of movement of the blade, an anvil on the opposite side of the path of movement of the blade engageable with the one surface of the sheet material, the anvil being inclined upwardly at an acute angle in the direction of feed, a pressure wheel mounted for movement with the blade, the wheel being rotatable about an axis normal to the blade, the pressure wheel being engageable with the opposite surface of sheet material supported on the anvil along a line which is parallel to the direction of movement of the blade, whereby the sheet material is supported by the feed means on one side of the path of movement of the blade and by the pressure wheel and anvil on the opposite side of the path of movement, and is substantially unsupported along the path of movement of the blade, and the axis of rotation of the pressure wheel being located in advance of the point where the edge of the blade intersects the plane of the sheet material, whereby the sheet material is held firmly against the anvil at all times while being cut.

9. A cutting and dispensing device according to claim 8 wherein, the blade is a single edge, backed razor blade.

10. A cutting and dispensing device according to claim 8 wherein, the blade is replaceable.

11. A cutting and dispensing device according to claim 8 wherein, the feed means are a pair of spring biased rolls.

12. A cutting and dispensing device according to claim 8 wherein, there are means for moving the cutting blade opposite to the direction of the cutting movement to reposition the blade for making another cut.

13. A sheet cutting and dispensing device according to claim 8 wherein, there is a clearance space through which the blade passes during the cutting operation.

14. A sheet cutting and dispensing device comprising:

a cutting blade supported in a plane by means movable along a straight path, the blade having a cutting edge inclined upwardly at an acute angle in the direction of movement, feed means located on one side of the path of movement of the blade for positioning sheet material in the path of movement of the blade, an anvil on the opposite side of the path of movement of the blade engageable with the one surface of the sheet material, a pressure wheel mounted for movement with the blade, the wheel being rotatable about an axis normal to the blade, the pressure wheel being engageable with the opposite surface of sheet material supported on the anvil along a line which is parallel to the direction of movement of the blade, whereby the sheet material is supported by the feed means on one side of the path of movement of the blade and by the pressure wheel and anvil on the opposite side of the path of movement, and is substantially unsupported along the path of movement of the blade, and, means for moving the cutting blade opposite to the direction of cutting movement to reposition the blade for making another cut in the sheet material.

15. A cutting and dispensing device according to claim 14 wherein, the blade is a single edge, backed razor blade.

16. A cutting and dispensing device according to claim 14 wherein, the blade is replaceable.

17. A cutting and dispensing device according to claim 14 wherein, the feed means are a pair of spring biased rolls.

18. A sheet cutting and dispensing device according to claim 14 wherein, there is a clearance space through which the blade passes during the cutting operation.

* * * * *